US006474484B1

(12) United States Patent
Miller, Jr.

(10) Patent No.: US 6,474,484 B1
(45) Date of Patent: Nov. 5, 2002

(54) INVENTORY CONTROL SYSTEM FOR WALK-IN DISPLAY COOLERS AND THE LIKE

(75) Inventor: Donald J. Miller, Jr., Belleville, IL (US)

(73) Assignee: Paul Flum Ideas, Inc., St. Louis, MO (US)

( * ) Notice: Subject to any disclaimer, the term of this patent is extended or adjusted under 35 U.S.C. 154(b) by 0 days.

(21) Appl. No.: 09/814,207

(22) Filed: Mar. 21, 2001

(51) Int. Cl.[7] ..... A47F 5/00

(52) U.S. Cl. ..... 211/162; 211/90.02; 211/187; 108/107; 312/201

(58) Field of Search ..... 211/187, 90.02, 211/162, 94.01, 175, 59.2; 312/201, 301; 108/107

(56) References Cited

U.S. PATENT DOCUMENTS

| | | | | |
|---|---|---|---|---|
| 2,098,828 A | | 11/1937 | Ludwick | |
| 2,685,491 A | | 8/1954 | Bulow | |
| 3,561,608 A | * | 2/1971 | Weider | |
| 3,570,682 A | * | 3/1971 | Elliott | |
| 4,270,661 A | * | 6/1981 | Rosenband | 211/59.2 |
| 4,292,902 A | * | 10/1981 | Barrineau | 211/187 X |
| 4,807,765 A | | 2/1989 | Brown et al. | |
| 4,898,283 A | * | 2/1990 | Kingsford | 211/162 X |
| 4,972,783 A | * | 11/1990 | Crissman et al. | 108/107 |
| 5,004,304 A | * | 4/1991 | Segerpalm et al. | 312/201 |
| 5,072,838 A | | 12/1991 | Price, Jr. et al. | |
| 5,205,627 A | | 4/1993 | Davison et al. | |
| 5,265,739 A | | 11/1993 | Price, Jr. et al. | |
| 5,490,600 A | | 2/1996 | Bustos | |
| 5,749,481 A | * | 5/1998 | Miller | 211/187 X |
| 5,943,967 A | | 8/1999 | Sherman | |
| 6,112,917 A | * | 9/2000 | Baker et al. | 211/162 |
| 6,158,600 A | * | 12/2000 | Ferrucci et al. | 211/90.02 |

OTHER PUBLICATIONS

New Generation Of Boltless Shelving, Aug. 28, 1999, Manufactured by E–Z–Rect Manufacturing Ltd., printed in Canada.

* cited by examiner

*Primary Examiner*—Robert W. Gibson, Jr.
(74) *Attorney, Agent, or Firm*—Blackwell Sanders Peper Martin LLP

(57) ABSTRACT

A product inventory control system is provided that utilizes both fixed and movable racks. The present system may be utilized in a walk-in display cooler or other product storage application to help with inventory management and to provide easy access to stored product. The racks of the present system include shelf support members that are selectively positionable at a plurality of different orientations so as to achieve different product support surface orientations relative to a horizontal The shelf support members are adapted for storing a plurality of different types of products and product containers. Movable racks are positioned in front of fixed racks whereby movement of a movable rack provides access to a rack positioned therebehind.

38 Claims, 9 Drawing Sheets

INVENTORY CONTROL SYSTEM FOR WALK-IN DISPLAY COOLERS AND THE LIKE

DETAILED DESCRIPTION

Background of the Invention

Walk-in product merchandising display coolers are commonly used in retail outlets such as convenience stores and grocery stores to display a wide variety of different types of products to the consumer. A walk-in cooler typically includes one or more consumer access doors that open into the store area to allow a consumer access to products from display racks and associated shelving positioned adjacent the access doors. Such walk-in display coolers also typically include a storage area located behind the display racks which permits both the storage of product to be ultimately placed on the display racks and provides room for employees to fill the display racks from the rear with products stored within the storage area of the cooler.

Products stored in such coolers include bottled and canned beverages which are heavy, cumbersome and have use-by dates which need to be honored in order to provide fresh product to the consumer. Typically, product is stored in the cooler storage area by stacking multiple layers of containerized product on the floor or on fixed position racks or pallets. Storage racks provided in such coolers are fixed both with respect to the floor surface and with respect to the individual shelves associated with the racks. In other words, the racks themselves are non-moveable and the individual shelves associated therewith are typically fixed at one orientation and are not capable of being adjustably positionable into more than one orientation such as a horizontal orientation and a gravity feed orientation. This presents at least two problems. Such storage systems can result in a firstmode of operation which means consumers could be sold outproduct or fresher product first while older product remains buried at the bottom of the stack. Also, the depth (front-to-rear) of the stacks of product is limited because access to rear positioned stacks is inhibited by front positioned stacks whether the stacks are positioned on the floor or on fixed racks or pallets.

Complicating the problem of product storage in walk-in type coolers or other storage space holding areas is the fact that walk-in display coolers tend to have limited storage space therein. Also, this limited space makes it difficult for employees to work and maneuver within the cooler thereby adversely affecting worker efficiency.

Moveable storage rack systems are known in the art. Such systems have one or more racks or shelving systems moveably mounted generally on guides (tracks) and such racks or shelving systems can be moved from side to side to provide access to racks or shelving systems located behind the moving rack(s). Such systems can include several racks positioned in spaced apart relationship from front to back with the back rack usually being fixed and non-moveable. Examples of such systems can be found in U.S. Pat. Nos. 5,205,627; 5,943,967; 5,265,739; 5,072,838; and 4,087,765. These patents disclose movable shelving units or racks that move on wheels along upwardly opening tracks such as upwardly opening grooves or on angle member tracks. If an object were to lie or become wedged in the upwardly opening groove, such object might derail the shelving unit during movement thereby causing damage to product and potentially injuring workers. Further, to protect against tipping over, many of the disclosed racks utilize a retention system positioned at the top of the shelves. The shelving system disclosed in U.S. Pat. No. 5,205,627 utilizes a bottom mounted anti-tip device and an upwardly opening groove for a track. None of the known shelving systems provide shelf members which are selectively positionable at a plurality of different angular orientations and none are adaptable for use as a product inventory control system as hereinafter described.

Thus, there is a need for an improved walk-in display cooler system which includes an inventory control system that will permit a firstmode of operation for re-stocking product and that can utilize the limited space in the storage area of the cooler more efficiently.

Accordingly, the present invention is directed to overcoming one or more of the problems as set forth above.

SUMMARY OF THE INVENTION

The present invention relates to a walk-in display cooler or other product storage area having a movable inventory control rack system that will provide for a first method of handling inventory in the cooler or other product storage area. The present rack system can include a plurality of movable racks and a plurality of fixed racks whereby movement of one or more movable racks provides access to racks located behind a movable rack. The rack system includes floor mounted tracks which guide support wheels mounted adjacent the bottom of the movable rack. Each rack, whether movable or fixed, includes a plurality of upright support structures adaptable for holding and supporting a plurality of shelves or product holding trays therebetween, each shelf or tray being supported by a pair of horizontally disposed front and rear shelf support members which are selectively attachable to elongated posts associated with the upright support structure. The front and rear shelf support members and the upright support structures are provided with cooperating attachment elements for mounting the shelf support members between the upright structures in various orientations whereby a shelf or product holding tray or container can be positioned to hold and store products at different angles relative to the floor surface.

Other objects and features will be in part apparent and in part pointed out hereinafter.

BRIEF DESCRIPTION OF THE DRAWINGS

For a better understanding of the present invention, reference may be made to the accompanying drawings.

Corresponding reference characters indicate corresponding parts throughout the several views of the drawings.

DETAILED DESCRIPTION OF THE INVENTION

Although the present rack system will be described with respect to use in a typical walk-in display cooler environment, its use is not so limited and it is recognized and anticipated that the present system will be utilized in a wide variety of different applications as will be hereinafter evident.

Figure 1:
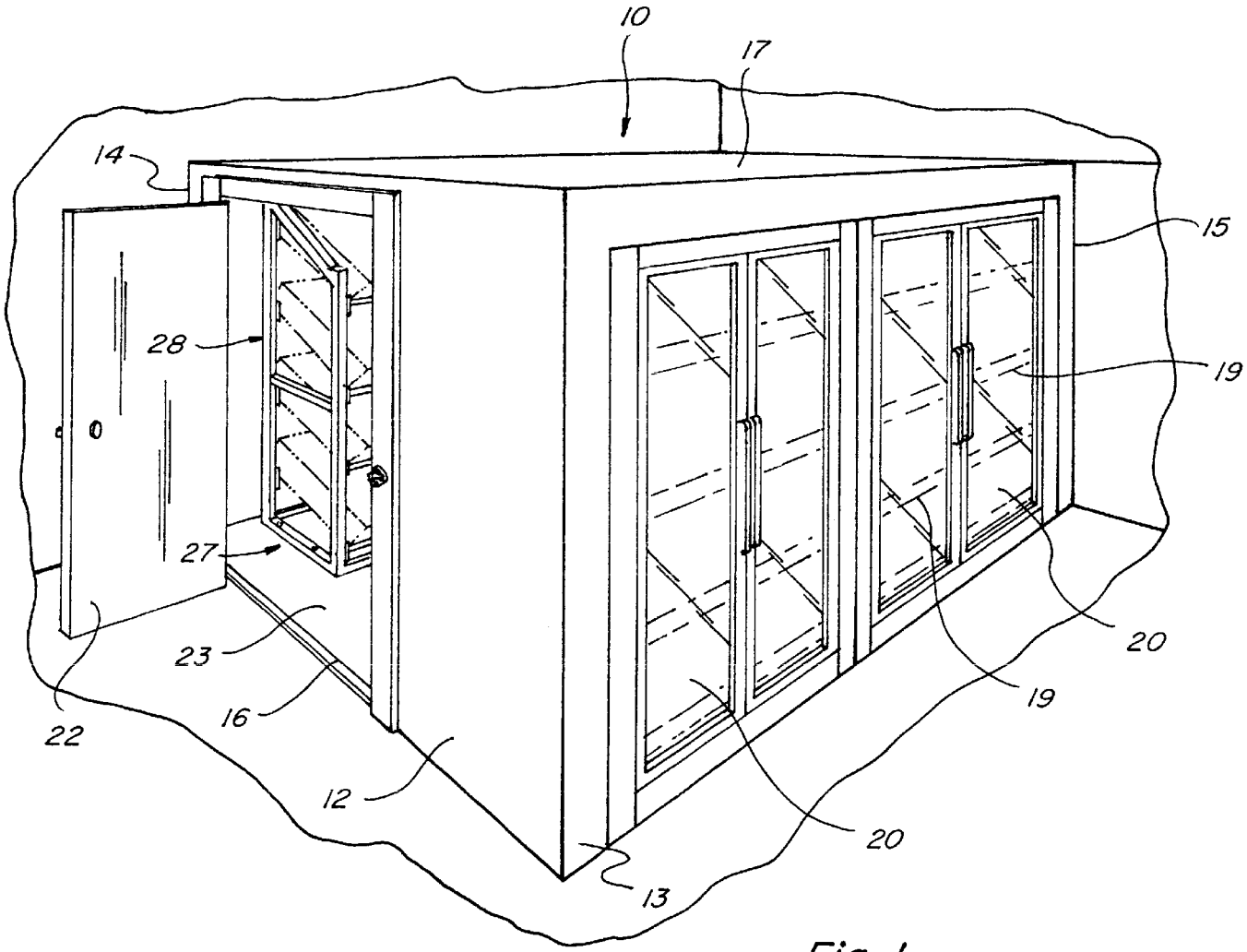
FIG. 1 is a perspective view of a walk-in display cooler having an entry door open to show a portion of the interior of the cooler.
Figure 2:
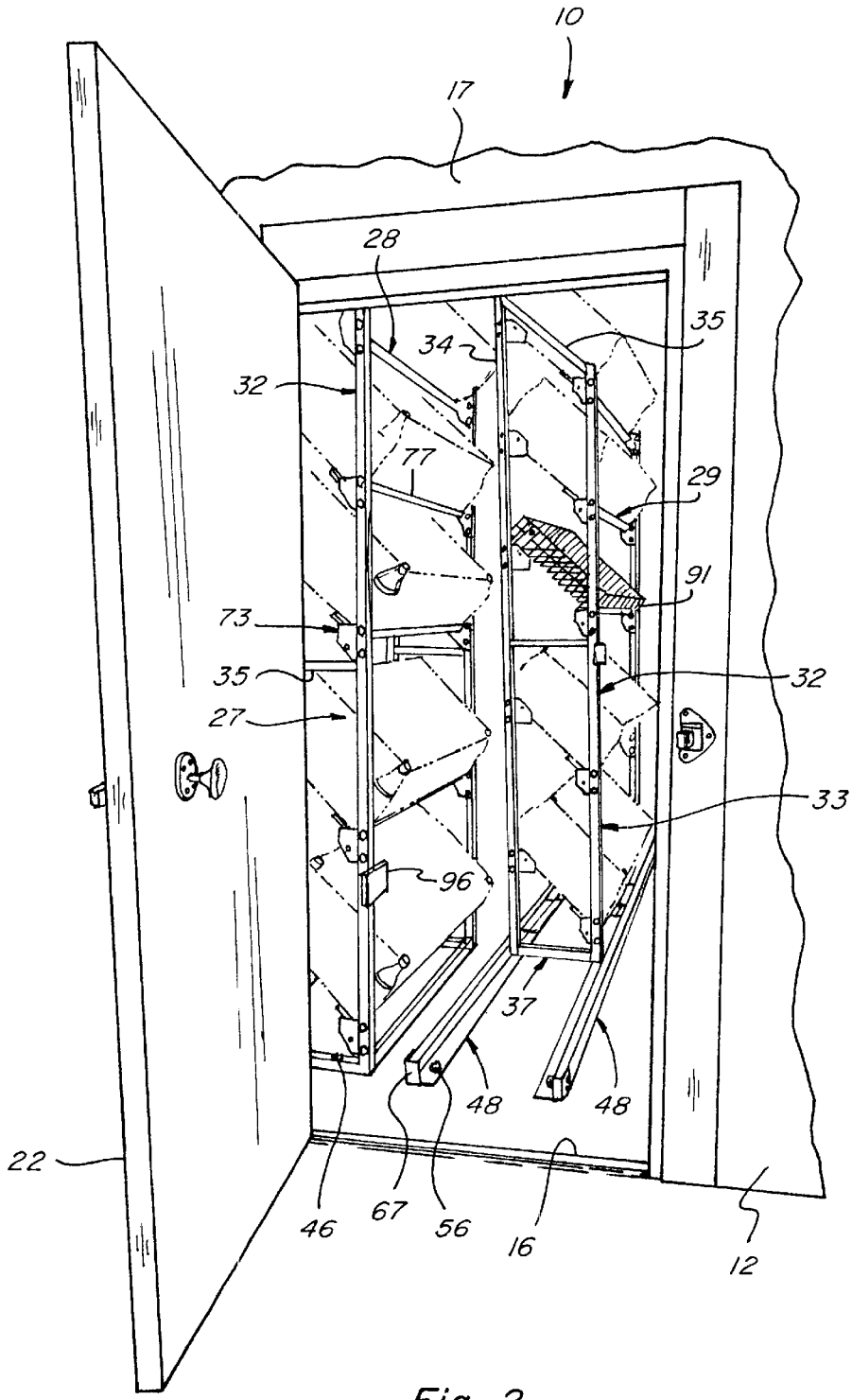
FIG. 2 is a fragmentary view of the cooler and rack system of FIG. 1 enlarged to show additional detail.

A typical walk-in cooler, as best illustrated in FIGS. 1 and 2, includes side walls 12, 13, 14 and 15, a floor 16, and a roof 17. The cooler 10 further includes a plurality of display racks 19 positioned at the front of the cooler adjacent to one or more customer access doors 20 associated with the front wall 13. The display racks 19 are used to hold and display product such as food items and beverages. The display racks 19 are filled by a worker from the rear of the respective racks while working inside the cooler 10. Typically, at least some of the shelves associated with the display racks 19 are inclined or sloped downwardly toward the doors 20 in a gravity feed orientation so that the products positioned and displayed thereon are self-feeding under the influence of gravity to the front of the display racks 19 for easy access through the cooler doors 20. The cooler 10 is also provided with an access door 22 for ingress and egress of a worker into and out of the interior 23 of the cooler 10 for both storing product within the cooler and for stocking and re-stocking the display racks 19. The above described cooler is of a type well-known in the art and can be found in a wide variety of retail outlets such as supermarkets, convenience stores, gas stations, grocery stores and the like.

A rack system designated generally 27 is provided in the interior 23 of the cooler 10 and preferably includes one or more fixed, non-moveable racks 28 and one or more movable racks 29 positioned in front of the fixed racks 28. Although only two rows of racks 28 and 29 are illustrated, it is recognized and anticipated that any suitable number of racks can be provided. In a particularly preferred embodiment, only the back row of racks 28 is fixed in position and is generally positioned adjacent a cooler wall to save space. The movable racks 29 are constructed to provide for lateral movement (side-to-side) in either direction. When access is needed to one rack behind another rack, the rack in the front is moved to the side providing access to a rack therebehind.

Figure 5:
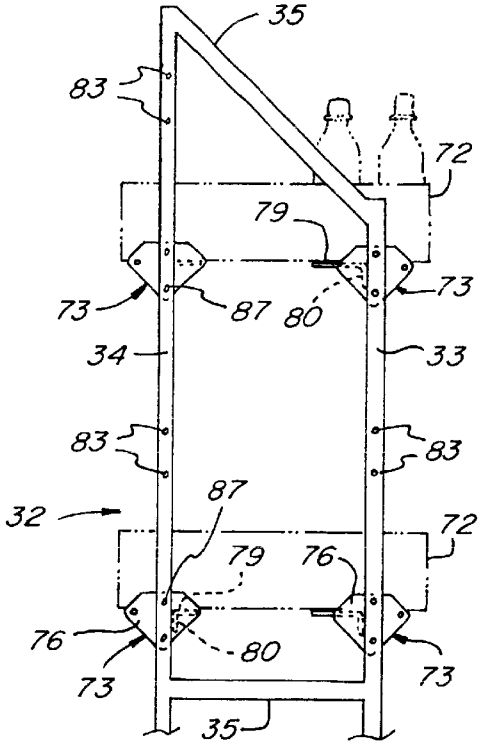
FIG. 5 is a fragmentary end view of one rack of the present system showing attachment of the front and rear shelf support members to the upright support structures with a product holding tray in position to form generally horizontal shelves.
Figure 6:
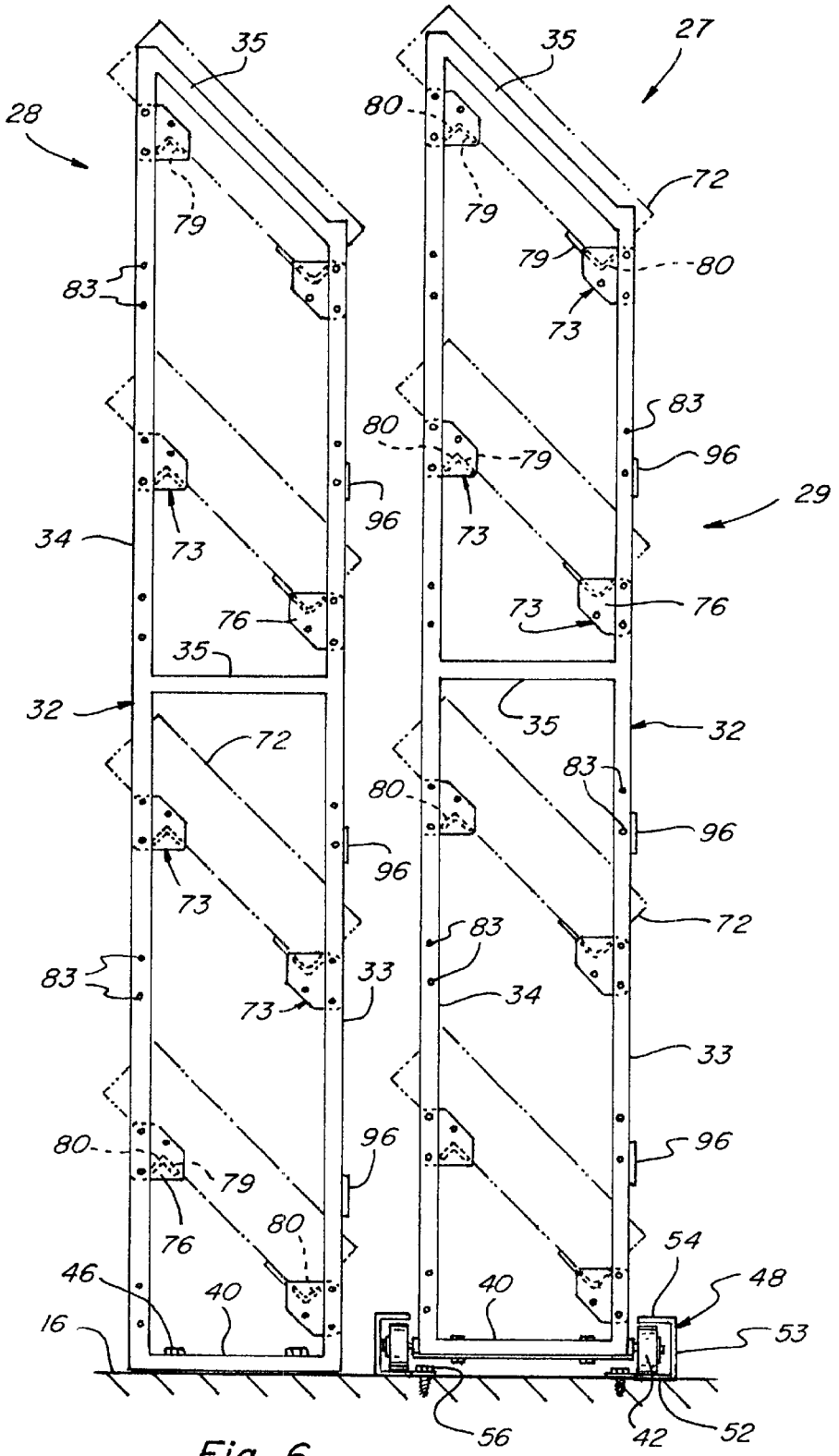
FIG. 6 is an end view of two rows of racks of the present system showing attachment of the front and rear shelf support members to the upright support structures in position to form downwardly sloping shelves.
Figure 9:
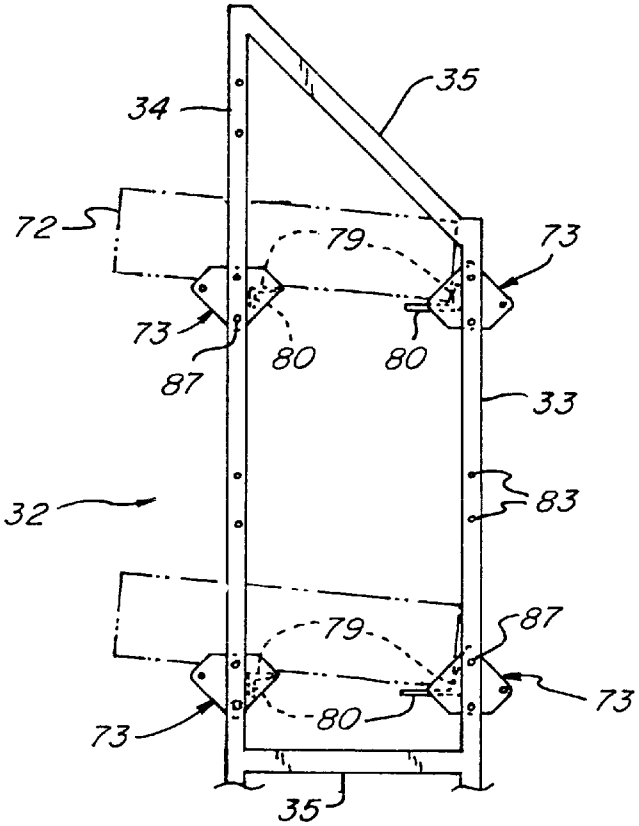
FIG. 9 is an enlarged fragmentary end view of racks showing the shelf support members in position to form a generally horizontal shelf with a front upturned lip.

For manufacturing convenience, the racks 28 and 29 are similar in construction and are comprised of a pair of spaced apart upright support structures 32 located at each opposite end of the respective racks 28 and 29 as illustrated in FIGS. 2, 5, 6 and 9, each upright structure 32 being generally vertical and parallel to one another. In the illustrated structure, each upright support structure 32 includes spaced front and back posts 33 and 34 respectively, or other equivalent upright elongated members, and one or more cross brace members 35 secured between a pair of front and back posts 33 and 34 to help rigidify the overall structure 32. As shown in FIGS. 5, 6 and 9, the top most brace member 35 is placed at an angle between front and rear posts 33 and 34 while the mid-brace member 35 can be positioned generally perpendicular to the post members 33 and 34. In this regard, it is recognized that any number of cross brace members 35 can be utilized to rigidify the overall upright structure 32 and that the brace members can be positioned and oriented in any manner between the front and rear posts 33 and 34 so long as rigidity is achieved.

Figure 14:
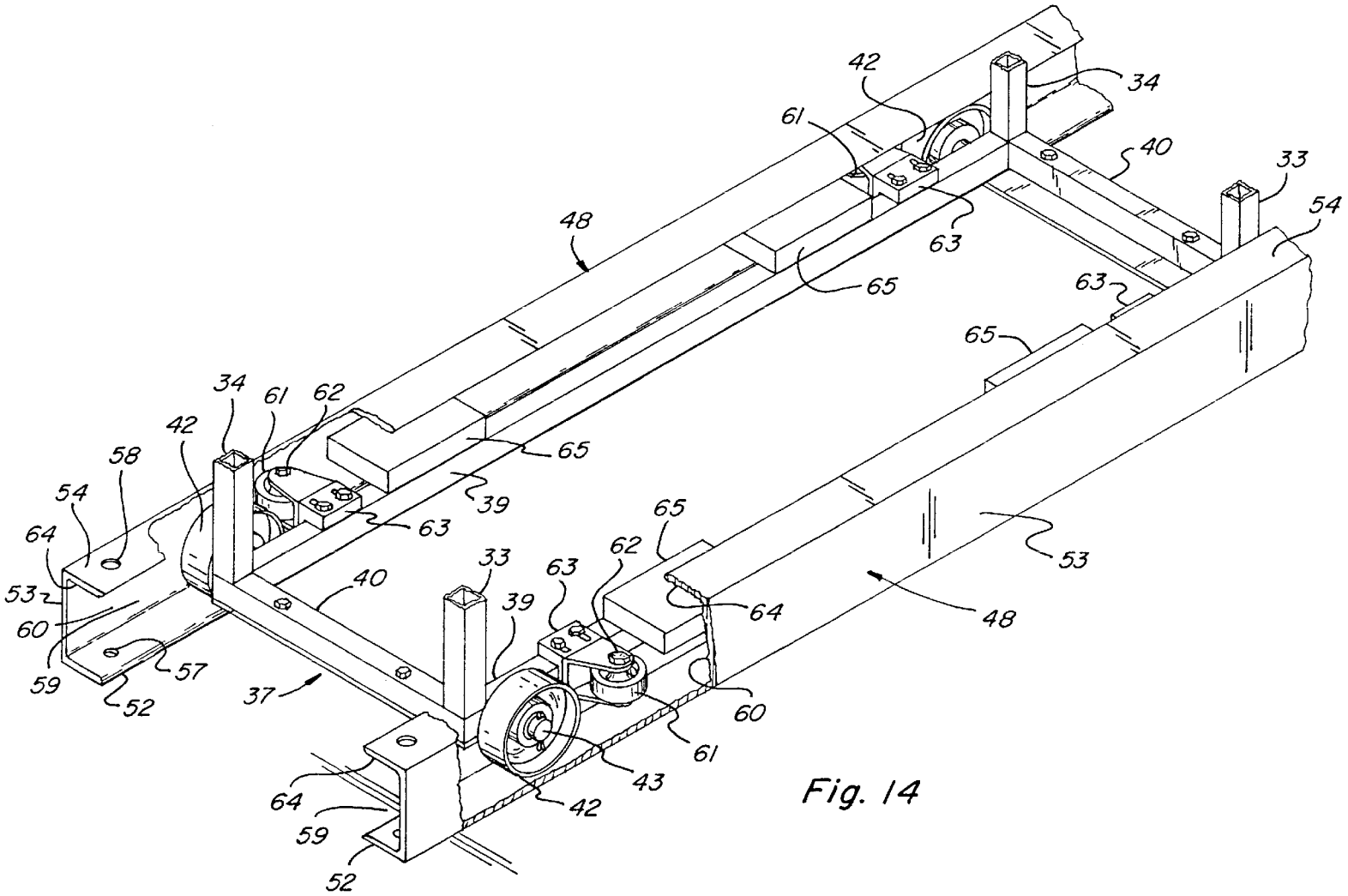
FIG. 14 is an enlarged fragmentary perspective view of the base frame of a rack operatively positioned within the tracks.
Figure 15:
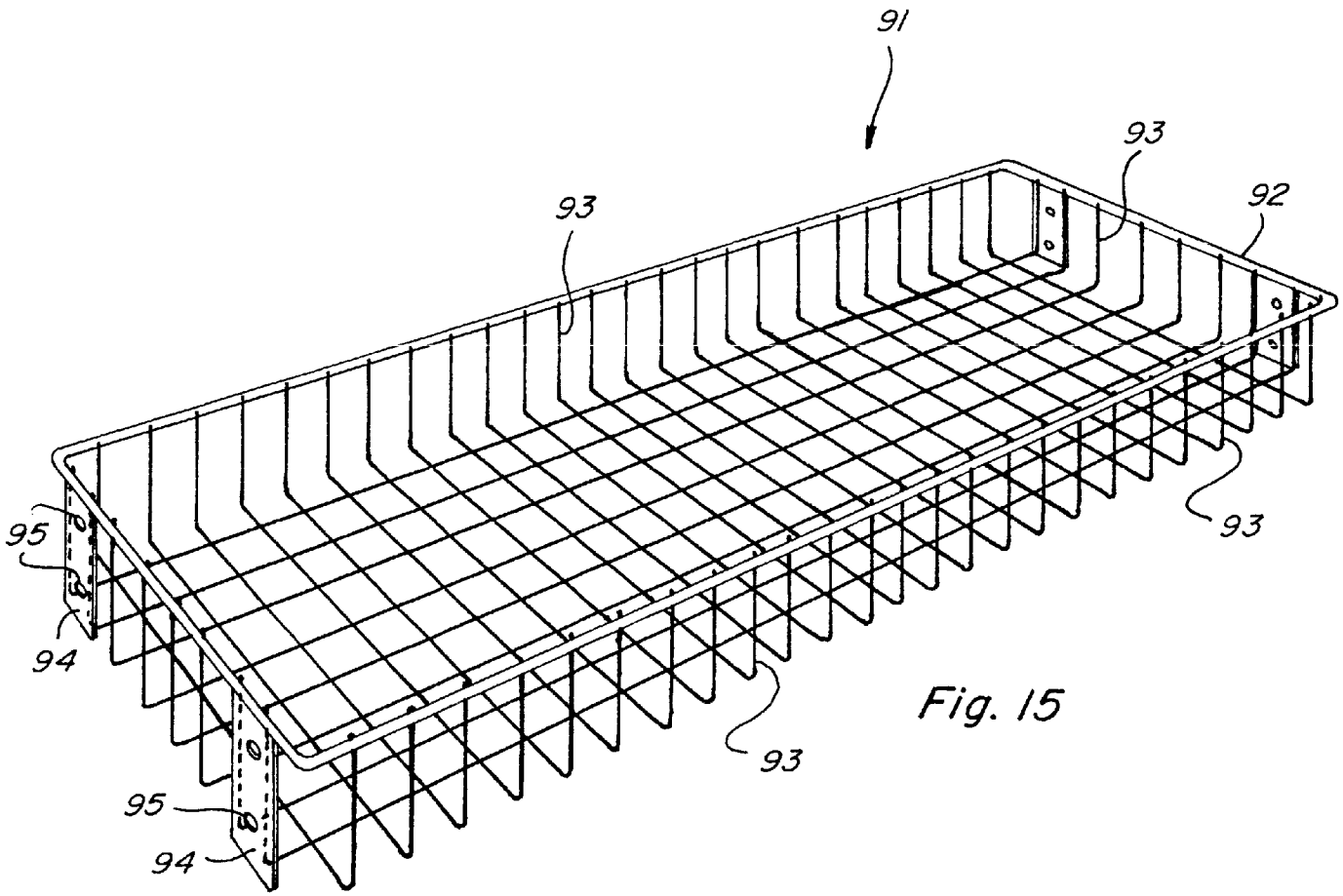
FIG. 15 is an enlarged perspective view of a basket shelf.

Each pair of upright support structures 32 is fixedly secured to a base frame member 37 as best illustrated in FIG. 14. The base frame 37 includes front and rear brace members 39 and end brace members 40 that are secured together forming a generally rectangular base frame. In a preferred embodiment, the upright support structures 32 and base frame 37 are welded together to form an integral structure. It is also preferred that the upright post members 33 and 34 and brace members 39 and 40 be of rectangular or square tubing. Likewise, cross brace members 35 may be of similar tubing and welded to the respective posts 33 and 34. Both the fixed racks 28 and the movable racks 29 are of substantially similar construction except that the movable racks have means associated therewith as will be hereinafter explained to allow for sideways movement of the racks 29. It is recognized and anticipated that the base frame 37 can be attached or otherwise joined to the upright post members 33 and 34 in any known manner and it is recognized and anticipated that the individual members or components forming the structures 32 and 37 can be of any cross-file shape.

Figure 3:
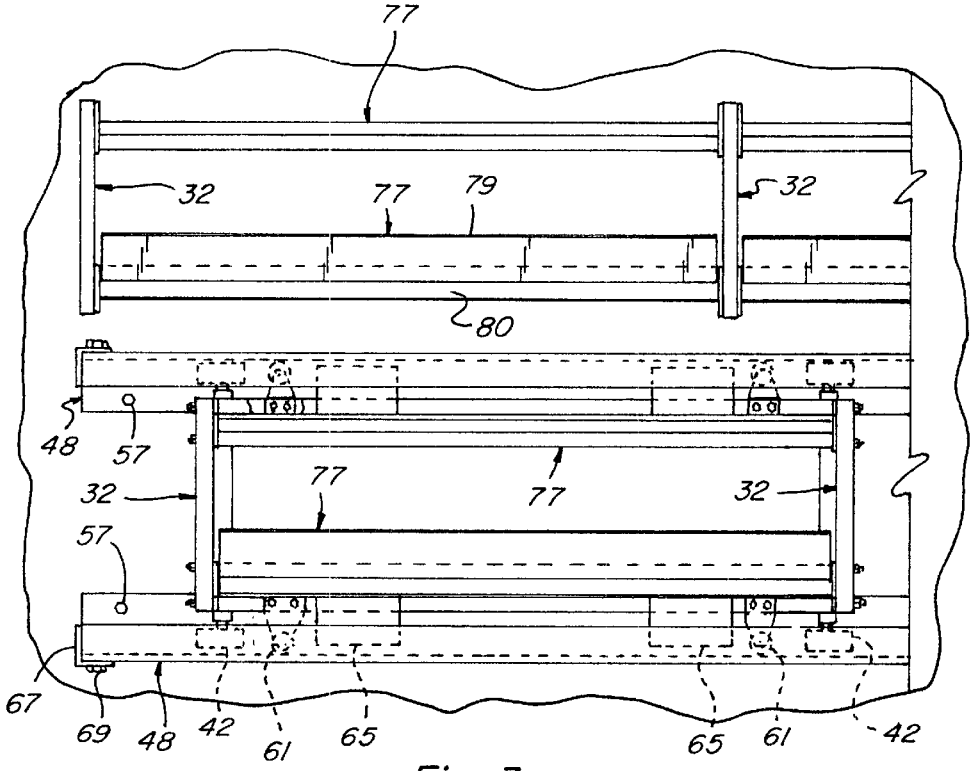
FIG. 3 is an enlarged fragmentary plan view of a fixed rack and a movable rack constructed in accordance with the teachings of the present invention.
Figure 4:
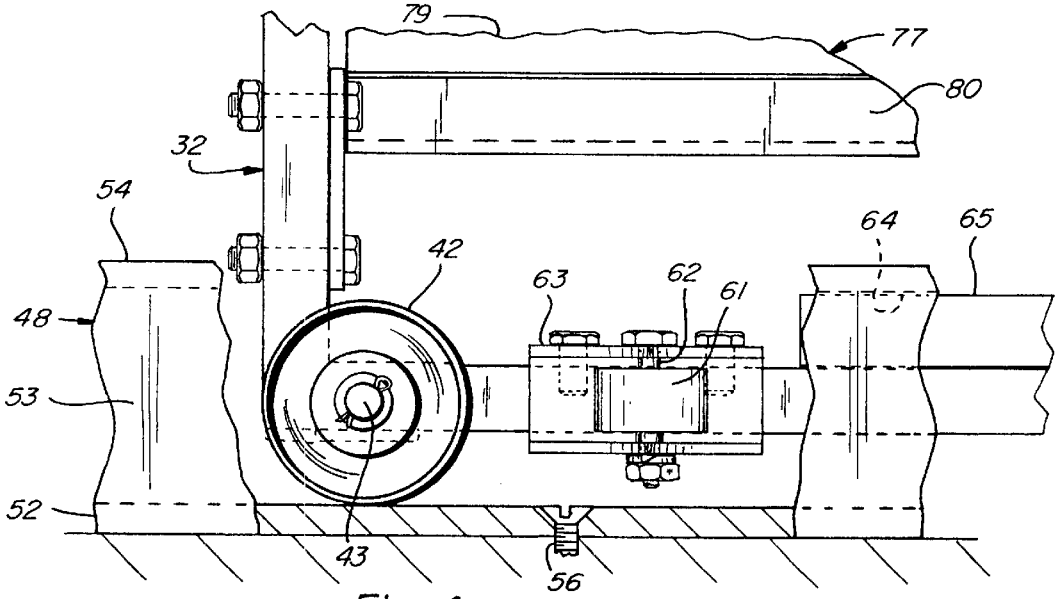
FIG. 4 is an enlarged fragmentary side view of a lower portion of the moveable rack of FIG. 3 showing the present support wheels and guide rollers.

As best seen in FIGS. 4 and 14, a wheel 42 is rotatably mounted to each movable rack 29 adjacent each of the four corners thereof. The greater the separation of the wheels, generally, the greater the stability of the overall rack 29 both when stationary and during movement. Each of the wheels 42 is rotatably mounted on an axle 43 which is secured to the base frame 37 as, for example, with brackets 44 and fasteners 45 as best shown in FIGS. 3, 4, 6 and 10. As illustrated, the wheels 42 each rotate on a generally horizontal axle 43 in a generally vertical plane. Preferably, the wheels 42 on each end of the rack, comprising end pairs of wheels, are equally spaced front-to-rear while the wheels on each end of the rack, comprising front and rear pairs of wheels, are equally spaced end-to-end to facilitate their being guided by track members described below. The fixed racks 28 may be simply secured to the floor surface with anchors bolts 46 through the base frame 37 or via other suitable securing means to prevent their movement and tipping.

Figure 10:
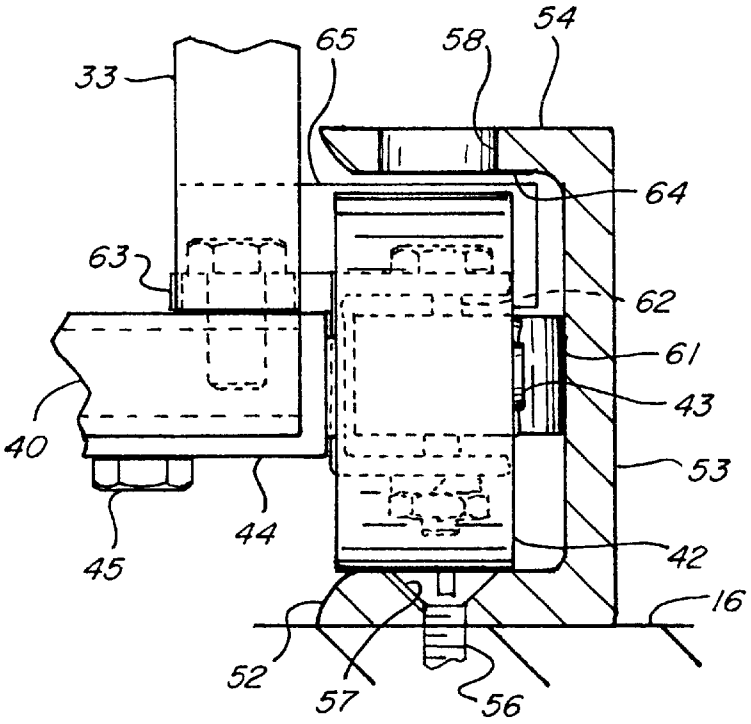
FIG. 10 is an enlarged end view of a wheel and guide roller in a track of the present invention.
Figure 11:
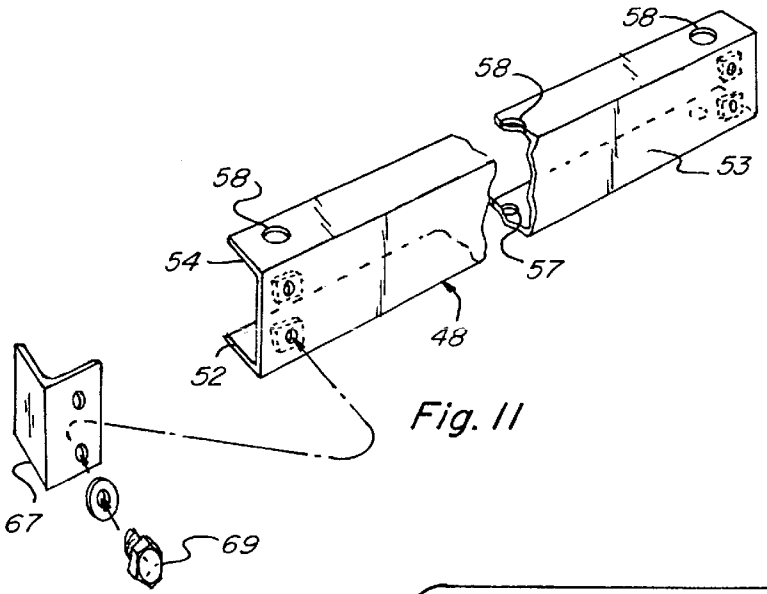
FIG. 11 is an enlarged perspective view of a track illustrating attachment of the stop members adjacent each opposite end of the track.

As best illustrated in FIGS. 2, 3, 4 and 14, floor tracks 48 are provided for receipt of the wheels 42 therein to provide guidance during sideways or lateral (end-to-end) movement of a rack 29 and to help prevent tipping of a rack. In a preferred embodiment, a track 48 captures either the front wheels or rear wheels 42 of a particular rack 29 preferably on three sides of the wheels, namely, the top, bottom, and one side thereof thereby preventing the wheels 42 from leaving their respective track 48. In the illustrated structure, a track 48 is comprised of a substantially U-shaped channel member having a base flange 52, an intermediate web 53, and a top flange 54. The track portions 52, 53 and 54 form closed side portions capturing the wheels 42 on three sides thereof. The track 48 may be made from formed sheet metal or other suitable material. The base flange 52 is adapted to rest on the floor and to be fixedly secured thereto as, for example, with bevel head screws 56 (FIG. 10) which extend through countersunk holes 57 in flange 52, or by any other suitable anchoring means. As illustrated in FIGS. 10, 11 and 14, the base flange 52 and top flange 54 have approximately the same width and apertures 58 would be provided through the top flange 54 to provide access for a fastening tool to extend therethrough to fasten the screws 56 to the floor. Alternately, the base flange 52 can have a width wider than the top flange 54 with the holes 57 located in an area outside of the overhang of the top flange 54 to help facilitate fastening of the screws or other fasteners 56 (FIGS. 3 and 6) to the floor. Each track 48 includes an open side 59 with the open sides of the front and rear tracks opening toward one another. The tracks 48 are secured to the floor and are generally parallel and have a spacing between inside surfaces 60 of the opposed webs 53 preferably larger than the outside spacing of the wheels 42 to provide clearance for the axles 43 and the fasteners securing the wheels thereto.

Guide means are also provided to assist in guiding the movement of a particular rack 29 within the tracks 48 to restrain cocking or tilting of a rack within a pair of tracks 48, that is, front-to-rear and/or rear-to-front movement of a rack within the tracks. As shown in FIGS. 4, 10 and 14, a plurality of guide rollers 61 are mounted on the base frame 37 projecting to the front or rear thereof for engagement with an inside surface 60 of a respective web 53. As shown, there is a guide roller 61 adjacent each of the wheels 42. The guide rollers 61 are mounted about a generally vertically oriented axle 62 for rotation in a generally horizontal plane. Each of the guide rollers 61 and respective axles 62 are mounted on a positionally adjustable bracket 63 that allows the front-to-rear position of a guide roller 61 to be adjusted to ensure proper spacing of the guide rollers for engagement with the respective webs 53. The front-to-rear spacing is also adequate to prevent contact of the axles 43 and wheels 42 with the inside surface 60 of the webs 53.

When a particular rack 29 is engaged with a pair of tracks 48, the wheels 42 are positioned between the flanges 52 and 54 and are therefore restrained against vertical movement thus helping to prevent the tipping of a particular rack 29. In one embodiment, supplemental anti-tip devices may be provided. Anti-tip devices may be required when the rack height to depth ratio exceeds 3:1 in some earthquake prone areas and 4:1 in other areas. As best seen in FIGS. 4, 10 and 14, a plate 65 is secured to the base frame 37 adjacent each of the four corners thereof. The plates 65 have an upper surface that is positioned just below the downward facing surface 64 of the top flange 54. In the event a rack starts to tip, the plates 65 will engage the top flange surface 64 and prevent tipping of the rack. The plates 65 may also prevent objects or debris from falling into the tracks 48.

Stop members 67 are secured to the tracks 48 adjacent each of the open ends thereof as best shown in FIGS. 3 and 11. Preferably the stop members 67 are removably secured to the opposite ends of each track 48 to allow for maintenance of unit and to simplify placement of a particular rack 29 within the tracks after the tracks 48 are secured to the floor. In this regard, it is recognized that any number of movable racks 29 may be positioned within a pair of tracks 48 depending upon the length of the tracks 48. As illustrated in FIGS. 3 and 11, the stop members 67 are L-shaped brackets secured to a respective web 53 with suitable fasteners such as the fasteners 69.

The fixed racks 28 are positioned in a cooler or other product storage area to the rear of the movable racks 29 as best shown in FIGS. 1 and 2. Sideways or lateral movement of a movable rack 29 allows access to a rack located therebehind, whether that rack be another movable rack 29 or a fixed rack 28. In practice, there may be a plurality of rows of movable racks each providing access to any rack, fixed or movable, therebehind. For example, if there are three rows of storage racks, the front two rows would be movable racks. Movement of a rack in the front row provides access to a movable rack in the middle row and if access is needed to a rear rack, racks in both the front and middle rows may be moved. Thus, floor space in a walk-in display cooler or other product storage area can be effectively utilized for storage of products which can be stored in a manner to allow a first inventory control method.

Figure 7:
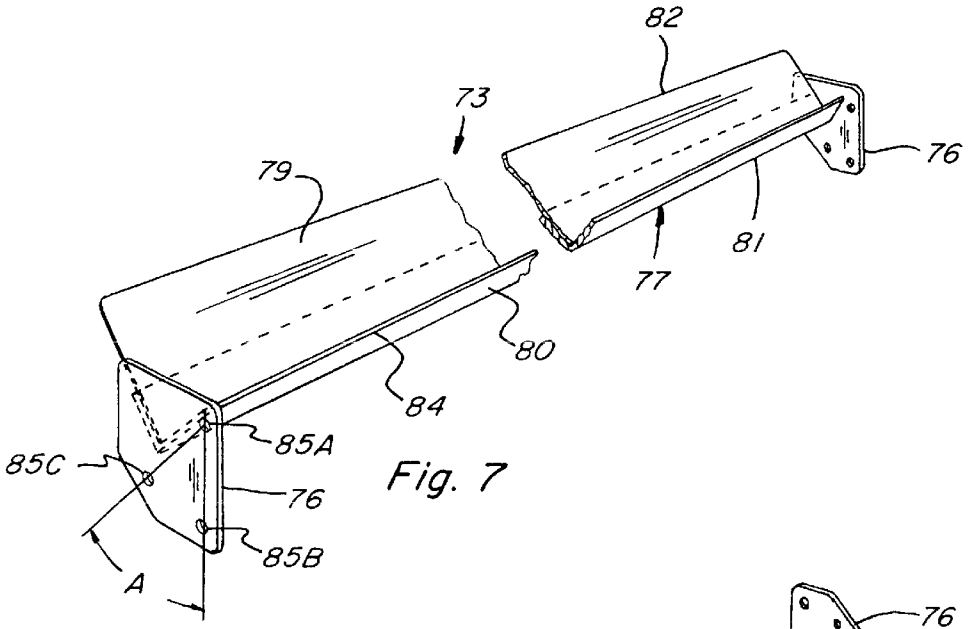
FIG. 7 is a perspective view of a shelf support member positioned in an orientation to provide either an inclined support surface with an upturned lip or a horizontal edge support surface.
Figure 8:
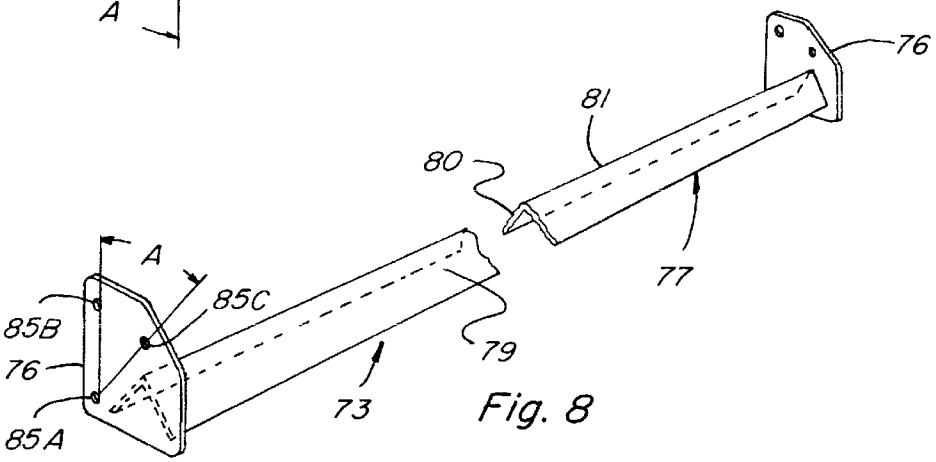
FIG. 8 is a perspective view of a shelf support member positioned in an orientation to provide either an inclined support surface with a downturned lip or a horizontal edge support surface.

The racks 28 and 29 of the present invention are provided with shelving units of various types that can be positioned at various positions and angles relative to the horizontal to enhance the flexibility and use of the present rack system. FIGS. 2, 5, 6 and 9 illustrate the use of one embodiment of a product holding tray or container 72 used in conjunction with a plurality of front and rear shelf support members 73 to achieve different angular orientations. The trays or containers 72 provide support for the product such as soft drink or other beverage products and are fully supported by the front and rear shelf support members 73. As illustrated, the front and rear shelf support members 73 (FIGS. 7 and 8) are separately attached to the corresponding upright posts 33 and 34 in one of several orientations as will be hereinafter further explained so as to achieve either a substantially horizontal planar orientation for the tray or container 72 as illustrated in FIG. 5, or to achieve one of several inclined planar orientations as illustrated in FIGS. 6 and 9. Preferably, the front and rear shelf support members 73 are of similar construction and can be used interchangeably. In one embodiment, the shelf support member 73 includes a pair of end brackets 76 with a support member or flange 77 secured to and extending therebetween. Preferably the end brackets 76 are of like construction so that a shelf support member 73 may be used in a left-right or right-left orientation to increase the versatility of the overall rack system as described below. As best illustrated in FIGS. 7 and 8, the support member or flange 77 is preferably an angle member comprising two flange portions, one flange portion forming the first component 79 and the second flange portion forming the second component 80. Either flange portion 79 or 80 may engage a container floor or the front or rear portion of a particular container 72 depending upon the orientation of the front and rear shelf support members 73 as best seen in FIGS. 2, 5, 6 and 9. For example, in the orientation illustrated in FIG. 6, the front shelf support member 73 is mounted between the opposed front posts 33 of a pair of upright support structures 32 so as to orient the flange portion 80 (FIG. 7) as a generally upturned lip which will engage the front portion of a product holding tray or container 72 to prevent the tray or container 72 from sliding forward out of the rack 28 or 29. In this orientation, the flange portion 80 serves as a stop member while flange portion 79 engages the bottom surface of the tray or container 72 and serves as a support surface for holding the forward portion of the tray or container 72 positioned thereon. In contrast, the rear shelf support member 73 is mounted between the opposed rear posts 34 of a pair of upright support structures 32 in spaced apart relationship above the corresponding front shelf support member 73 so as to orient the flange portion 79 (FIG. 8) to engage the bottom surface of the container 72 while the other flange portion 80 is oriented in a generally downturned orientation to prevent interference with the tray or container 72. This orientation is shown in FIGS. 6 and 8. In this particular arrangement of shelf support members 73, the front and rear shelf support members are positioned such that when a container or tray 72 is positioned thereupon as illustrated in FIG. 6, the tray or container 72 is oriented at an angle say, for example, 45° from the horizontal allowing enhanced access to the contents of the container 72. This orientation also provides for a gravity feed arrangement if the product stored in the container 72 are beverage type products wherein remaining product will slide downwardly and forward when a lead product is removed therefrom.

FIG. 5 shows another configuration wherein the front and rear shelf support members 73 are oriented relative to the upright posts 33 and 34 so as to form a generally horizontal support surface providing two flange portions 79 for engaging the bottom surface of a container 72 whereas the flange portions 80 are downturned to prevent interference with the container 72. A horizontal support surface or plane can also be provided by orienting the front and rear shelf support members 73 relative to the upright posts 33 and 34 in positions similar to FIGS. 7 and/or 8 such that the bottom surface of the tray or container 72 will engage either the apex 81 (FIG. 8) of the support flange 77 formed by the intersection of the flange portions 79 and 80, or the edge portions 82 and 84 of the support flange 77 (FIG. 7). As a result, in combination, the front and rear shelf support members 73 may be oriented with two upturned flange portions 79 and 80, two downturned flange portions 79 and 80, one flange portion 79 or 80 on the front shelf support member 73 being upturned and one flange portion 79 or 80 on the rear shelf support member 73 being downturned, or one flange portion 79 or 80 on the rear shelf support member 73 being upturned while the front shelf support member 73 has a horizontal flange portion and a downturned flange portion. FIG. 9 represents an orientation wherein the front shelf support member 73 has an upturned flange portion and the rear shelf support member 73 has a downturned flange portion. Such versatility provides for a variety of different tray or container orientations depending upon the positioning of the front and rear shelf support member 73 relative to each other and relative to the upright posts 33 and 34, any one or more of which are easily adaptable to the particular product and container 72 being stored.

In order to provide the aforementioned orientations of the flange portions 79 and 80, the end brackets 76 and the upright support structures 32 are provided with cooperating attachment elements to selectively secure the shelf support members 73 in their various orientations simply and easily. A preferred embodiment of attachment elements is illustrated in FIGS. 6 and 7. In this regard, the front and back posts 33 and 34 are each provided with a plurality of spaced apart apertures 83 along the length thereof. Any suitable spacing and number of apertures 83 may be provided depending upon the versatility desired for a particular rack and the number of shelf positions desired in a rack. As seen, the apertures 83 are positioned in a line along respective upright posts 33 and 34 and are formed in pairs, each pair of apertures 83 being spaced apart a distance corresponding to the spacing of apertures 85 associated with the end brackets 76.

Figure 12:
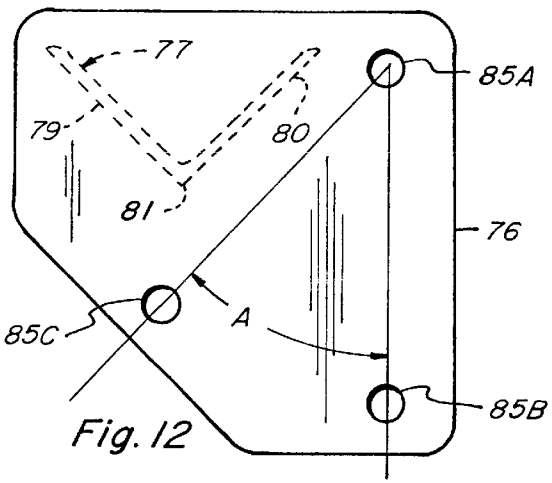
FIG. 12 is an enlarged end view of a shelf support member oriented similar to the shelf support member of FIG. 7.

The brackets 76 are generally in the form of a plate having a plurality of apertures 85 therethrough. A support flange or element 77 is secured to and extends between inside faces of the bracket 76. Preferably the brackets 76 and support flange 77 are metal and are welded together when heavy loads are contemplated. The apertures 85 extend through the bracket 76 each with a longitudinal axis generally parallel to the longitudinal axis of the support flange 77. The length of a shelf support member 73 is generally the same as the spacing between the inside surfaces of the upright support structures 32. The apertures 85 are arranged in a pattern to provide various orientations of mounting as described above. One particularly advantageous pattern of apertures 85 is best seen in FIGS. 6–8. This pattern utilizes three apertures 85 forming two sets of apertures with the apertures of each set having a spacing substantially equal to the spacing between the pairs of apertures 83 associated with each of the posts 33 and 34. As illustrated in FIGS. 7, 8 and 12, the aperture 85A forms a pair with aperture 85B and another pair with aperture 85C, the aperture 85A being at an apex of an angle A formed between the two pairs of apertures. Preferably the angle A between the three apertures is in the range of between about 30° through about 60° and preferably about 45°, however, other angles or multiple angles (using additional apertures) may be utilized depending upon the particular arrangement of shelf support members desired.

In one mounting position, as illustrated in FIG. 9, fasteners 87, such as bolts and nuts, are placed through the apertures 85A and 85B, which positions the shelf support member 73 for use as a front shelf support member 73 with an upturned lip or flange portion 79 to hold and stop the trays or containers 72 from sliding out of the unit. By utilizing the apertures 85A and 85C, the flange portion 80 is substantially vertical and extends upwardly, while the flange portion 79 is generally horizontal extending forward or rearward. By reversing the ends or brackets 76 (left-to-right) associated with the shelf support member 73, the flange portion 80 would now be downturned and generally vertical, while the flange portion 79 would remain generally horizontal. By reversing the ends (left-to-right), inverting the shelf support member 73, and utilizing the apertures 85A and 85B, the shelf support member 73 may be used as a rear shelf support member 73 whereby the flange portion 79 would provide support for the product container. Such a configuration is seen in FIGS. 5 and 9. In the specific shelf support member 73 illustrated in FIGS. 7, 8 and 12, the flange portion 80 is generally parallel to a line between the centers of the apertures 85A, 85C and the flange portion 79 is generally perpendicular thereto. The front and rear shelf support members 73 secure and hold the upright support structures 32 together.

Figure 13:
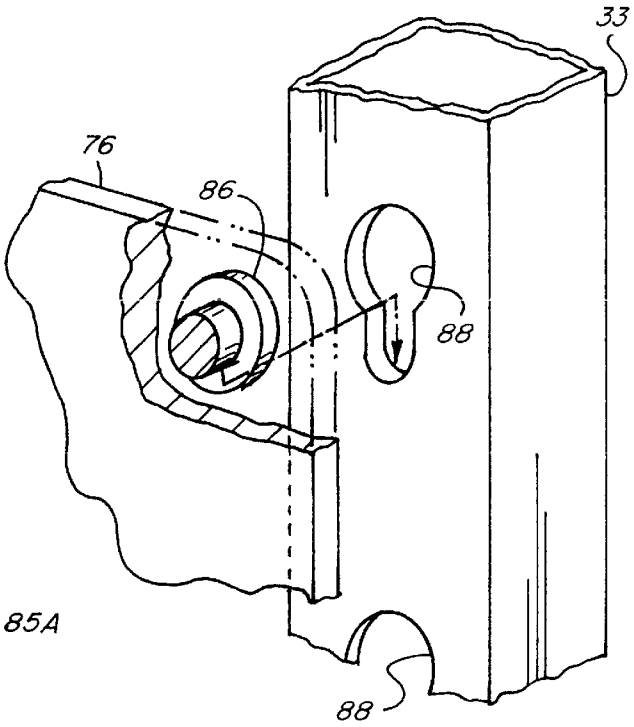
FIG. 13 is an enlarged fragmentary perspective view of an alternate way to attach a shelf support member to an upright support structure.

Alternate attachment elements for the shelf support members 73 may be provided. For example, a T-headed stud 86 as illustrated in FIG. 13 may be secured to either the bracket 76 or the posts 33 and 34, and the other corresponding member (bracket 76 or posts 33 and 34) may be provided with key slots 88 to eliminate the need for the use of separate fasteners such as the fasteners 87. Such fastening devices are commonly used on bed frames and the like and are well known in the art. The positions of the studs 86 and the slots 88 can be similar to the positions of the apertures 83 and 85.

FIGS. 2 and 11 illustrate a basket-type shelf arrangement designated generally 91. The basket 91 is formed by a plurality of interconnected wires 93 forming a floor and four upstanding walls. A top frame member 92 is also provided securing the upper portions of the wires 93 around the periphery of the side walls. Attachment brackets 94 are secured to opposite ends of the basket 91 and have apertures 95 for the receipt of fasteners therethrough such as the fasteners 87 to secure the basket 91 to the posts 33 and 34 associated with the upright support structures 32. Appropriately spaced and positioned apertures 95 would permit mounting the basket 91 either horizontally or at an angle, depending upon the position and location of the attachment brackets 94 and the apertures 95. The basket 91 would be advantageous for the storage of small packaged items such as candy bars, ice cream, small food items and the like.

As best seen in FIGS. 2 and 6, a rack 28 or 29 could be provided with one or more modules 96 having indicia thereon indicative of a use-by date or other appropriate date by which the product stored in the rack at that particular location should be sold or distributed. Module 96 can include a mechanism for setting a date through the use of a plurality of numbered wheels or rollers, or alternatively, a surface could be provided on which a date could be written and subsequently erased, if desired. This use-by identification system will facilitate the first-in/first-out re-stocking mode of operation.

Although the present product storage and inventory control system has been described with respect to use in a walk-in cooler environment, it is recognized and anticipated that the present system could be utilized in any product storage application where products are stored and held for re-stocking purposes or for other use at a later date. The present system also has utility in other applications such as other storing applications and providing easy access to a wide variety of different goods such as tooling, industrial supplies, and the like.

In view of the foregoing, it will be seen that the several objects of the invention are achieved and other advantages are attained. Although the foregoing includes a description of the best mode contemplated for carrying out the present invention, various modifications are conceivable. As various modifications could be made in the constructions and methods herein described and illustrated without departing from the scope of the invention, it is intended that all matter contained in the foregoing description or shown in the accompanying drawings shall be interpreted as illustrative rather than limiting.

Other aspects, objects and advantages of the present application can be obtained from a study of the drawings, the disclosure and the appended claims.

What is claimed is:

1. A product storage system comprising:

a rack with at least one shelf for storing product;

a pair of tracks secured to a support surface, said tracks each including a channel member having a pair of spaced apart top and bottom flanges and a connecting intermediate web extending therebetween defining a side opening guide channel in each track, the top and bottom flanges of each track including free spaced apart elongate edges defining said respective side opening guide channels, the side opening guide channels of said pair of tracks facing one another;

a plurality of wheels rotatably mounted to said rack adjacent a lower portion thereof for receipt in a respective side opening guide channel, each of said wheels rotating about a generally horizontal axis;

said wheels and tracks permitting restrained movement of the rack in two directions; and at least one lateral guide engagable with each track, each lateral guide including a side roller rotatably mounted to said rack about a generally vertical axis, said side roller being engagable with said intermediate web to help guide movement of the rack along said tracks.

2. The product storage system as set forth in claim 1 wherein said rack includes a base frame portion, said plurality of wheels being rotatably mounted to said base frame portion, and at least a pair of plate members associated with said base frame portion, one of said plate members being selectively engagable with a portion of one of said tracks and the other of said plate members being selectively engagable with a portion of the other of said tracks to prevent the rack from tipping over in a front to rear direction.

3. An adjustable rack for the storage of products comprising:

a pair of spaced apart upright support structures, each of said upright support structures having a plurality of sets of first attachment elements spaced along the length thereof, and at least two shelf support members, each shelf support member having a mounting bracket associated with each opposite end thereof, said mounting brackets each including a plurality of second attachment elements selectively cooperating with a selected set of first attachment elements, each mounting bracket including at least three second attachment elements positioned to form a generally V-shaped pattern with the angle between the legs of the V being in the range from between about 30° to about 60°, said second attachment elements being positioned relative to one another to permit mounting of a shelf support member selectively at one of a plurality of different orientations relative to said upright support structures, at least two of said shelf support members being mounted to said upright support structures to form a product support surface for the storage of products.

4. The adjustable rack as set forth in claim 3 wherein said first attachment elements include first apertures and said second attachment elements include second apertures, selected second apertures being selectively alignable with selected first apertures for mounting said shelf support members to said pair of upright support structures at a particular orientation.

5. The adjustable rack as set forth in claim 3 wherein said second attachment elements include a plurality of projecting studs and said first attachment elements include a plurality of corresponding key slots adaptable to receive said projecting studs, said key slots being selectively alignable with certain selected studs for mounting said shelf support members to said pair of upright support structures.

6. The adjustable rack as set forth in claim 3 wherein one of said second attachment elements associated with each of said brackets is located at the apex of said generally V-shaped pattern and is selectively aligned with one of said first attachment elements in a selected set of first attachment elements for at least two mounting positions of said shelf support structures.

7. The adjustable rack as set forth in claim 3 wherein said upright support structures each include a front member and a rear member, at least one shelf support member being mounted to and extending between-said pair of front members and at least one shelf support member being mounted to and extending between said pair of rear members, said shelf support members each including a support flange extending between said brackets, said support flanges each having at least one support surface associated therewith, at least one support surface of a rear positioned shelf support member and at least one support surface of a front positioned shelf support member forming a product support surface for the storage of products.

8. The adjustable rack as set forth in claim 7 wherein a front positioned shelf support member is positioned at a level below the level of a correspondingly positioned rear shelf support member so as to form an inclined plane.

9. The adjustable rack as set forth in claim 8 wherein the front shelf support member is positioned such that at least one support surface of the support flange extending between said brackets forms a generally upwardly directed lip portion for retaining a product holding container positioned thereon.

10. The adjustable rack as set forth in claim 7 wherein a front positioned shelf support member is positioned at a level approximately equal to the level of a correspondingly positioned rear shelf support member so as to form a substantially horizontal plane.

11. The adjustable rack as set forth in claim 7 wherein at least one support surface of the support flange associated with a front positioned shelf support member forms a generally upwardly directed lip portion and at least one support surface of the support flange associated with a correspondingly positioned rear shelf support member forms a generally downwardly directed lip portion.

12. The adjustable rack as set forth in claim 7 wherein at least one support surface of the support flange associated with a front positioned shelf support member forms a generally horizontal support surface and at least one support surface of the support flange associated with a correspondingly positioned rear shelf support member forms a generally horizontal support surface.

13. The adjustable rack as set forth in claim 7 wherein at least one support surface of the support flange associated with a front positioned shelf support member forms a generally downwardly directed lip portion and at least one support surface of the support flange associated with a correspondingly positioned rear shelf support member forms a generally downwardly directed lip portion.

14. A product storage rack comprising:

a base frame member having a plurality of wheels rotatably mounted thereto;

a pair of spaced apart upright support structures extending upwardly from said base frame member, each of said upright support structures having a plurality of sets of first apertures spaced along the length thereof;

at least two shelf support members, each shelf support member having a mounting bracket associated with each opposite end thereof, said mounting brackets each including a plurality of second apertures selectively cooperating with a selected set of said first apertures associated with said upright support structures, said second apertures being selectively positioned relative to said selected set of first apertures to permit mounting of a shelf support member selectively at one of a plurality of different orientations relative to said upright support structures, at least two of said shelf support members being mountable to said upright support structures to form a product support surface;

a pair of tracks secured to a support surface, said tracks each having an open side portion defining a guide channel for receiving any one of said plurality of wheels, said pair of tracks being positioned and arranged such that the respective open side portions defining said guide channels face each other, said plurality of wheels and tracks permitting movement of said pair of upright support structures in two directions when said wheels are engaged with the guide channels of said tracks.

15. The product storage rack as set forth in claim 14 wherein said base frame member includes at least a pair of lateral guide members, one of said lateral guide members being engagable with each of said tracks.

16. The product storage rack as set forth in claim 15 wherein each lateral guide member includes a side roller rotatable about a generally vertical axis, said side roller being engagable with a respective track to glide movement of said base frame member and said upright support structures along said tracks.

17. The product storage rack as set forth in claim 14 including at least a pair of plate members associated with said base frame member, one of said plate members being selectively engagable with one of said tracks while the other of said plate members being selectively engagable with the other of said tracks.

18. The product storage rack as set forth in claim 14 wherein said at least two shelf support members can be selectively mounted to said upright support structures so as to form either a substantially horizontal product support surface or an inclined product support surface.

19. A product inventory control system comprising:

at least two product holding racks positioned in spaced apart relationship relative to each other;

at least one of said product holding racks including a base frame member, a pair of spaced apart upright support structures extending upward from said base frame member, a plurality of wheels rotatably mounted to said base frame member, and at least two shelf support members;

each of said upright support structures including a plurality of sets of first attachment elements spaced along the length thereof, each of said shelf support members including a pair of mounting brackets and a support flange extending therebetween, each of said mounting brackets having a plurality of second attachment elements associated therewith, said second attachment elements being positioned so as to be selectively engagable with a selected set of said first attachment elements to permit mounting of said shelf support member selectively at a plurality of different orientations relative to said upright support structures, said at least two of said shelf support members being mountable to said upright support structures to form a product support surface for the storage of products thereon;

a pair of tracks secured in spaced apart relationship to a support surface, each of said tracks including an open guide channel for receiving any one of said plurality of wheels mounted to said base frame member, said tracks permitting restrained movement of said at least one product holding rack in two directions when said plurality of wheels are engaged with the respective guide channels associated with said tracks;

said at least one product holding rack being movable relative to the other of said product holding racks so as to provide access thereto.

20. The product inventory control system as set forth in claim 19 wherein the open guide channels of said pair of tracks face each other.

21. The product inventory control system as set forth in claim 19 including at least one lateral guide member engagable with each track to help guide movement of said at least one product holding rack along said tracks.

22. The product inventory control system as set forth in claim 21 wherein each lateral guide member includes a side roller rotatably mounted to said base frame member, said side roller being rotatable about a generally vertical axis.

23. The product inventory control system as set forth in claim 19 including at least a pair of plate members associated with said base frame member, one of said plate members being selectively engagable with at least a portion of one of said tracks and the other of said plate members being selectively engagable with at least a portion of the other of said tracks to prevent said at least one product holding rack from tipping over in a front or rear direction.

24. The product inventory control system as set forth in claim 19 wherein said first attachment elements include first apertures and said second attachment elements include second apertures, selected second apertures being selectively alignable with selected first apertures for mounting said shelf support members to said pair of upright support structures at a particular orientation.

25. The product inventory control system as set forth in claim 19 wherein said mounting brackets each include at least three second attachment elements positioned to form a generally Vpattern with the angle between the legs of the V-shaped pattern being in the range from between about 30° to about 60°.

26. The product inventory control system as set forth in claim 19 wherein said second attachment elements include a plurality of projecting studs and said first attachment elements include a plurality of corresponding key slots adaptable to receive said projecting studs, said key slots being selectively alignable with certain selected studs for mounting said shelf support members to said pair of upright support structures.

27. The product inventory control system as set forth in claim 25 wherein one of said second attachment elements associated with each of said mounting brackets is located at the apex of said generally Vpattern and is selectively aligned with one of said first attachment elements in a selected set of first attachment elements for at least two mounting positions of said shelf support structures.

28. The product inventory control system as set forth in claim 27 wherein said upright support structures each include a front member and a rear member, at least one shelf support member being mounted to and extending between said pair of front members and at least one shelf support member being mounted to and extending between said pair of rear members, said shelf support members each including a support flange extending between said mounting brackets, said support flanges each having at least one support surface associated therewith, at least one support surface of a rear positioned shelf support member and at least one support surface of a front positioned shelf support member forming a product support surface for the storage of products.

29. The product inventory control system as set forth in claim 28 wherein a front positioned shelf support member is positioned at a level below the level of a correspondingly positioned rear shelf support member so as to form an inclined plane.

30. The product inventory control system as set forth in claim 28 wherein the front shelf support member is positioned such that at least one support surface of the support flange extending between said mounting brackets forms a generally upwardly directed lip portion for retaining a product holding container positioned thereon.

31. The product inventory control system as set forth in claim 28 wherein a front positioned shelf support member is positioned at a level approximately equal to the level of a correspondingly positioned rear shelf support member so as to form a substantially horizontal plane.

32. The product inventory control system as set forth in claim 28 wherein at least one support surface of the support flange associated with a front positioned shelf support member forms a generally upwardly directed lip portion and at least one support surface of the support flange associated with a correspondingly positioned rear shelf support member forms a generally downwardly directed lip portion.

33. The product inventory control system as set forth in claim 28 wherein at least one support surface of the support flange associated with a front positioned shelf support member forms a generally horizontal support surface and at least one support surface of the support flange associated with a correspondingly positioned rear shelf support member forms a generally horizontal support surface.

34. The product inventory control system as set forth in claim 28 wherein at least one support surface of the support flange associated with a front positioned shelf support member forms a generally downwardly directed lip portion and at least one support surface of the support flange associated with a correspondingly positioned rear shelf support member forms a generally downwardly directed lip portion.

35. The product inventory control system as set forth in claim 19 wherein said inventory control system is utilized within a walk-in display cooler.

36. The product inventory control system as set forth in claim 19 wherein the other of said at least two product holding racks is fixedly secured to a support surface.

37. The product inventory control system as set forth in claim 19 including at least one module associated with each product holding rack, said module having indicia thereon indicative of a use-by date by which product stored in the rack should be sold.

38. The product inventory control system as set forth in claim 21 wherein each lateral guide is adjustably positionable relative to a respective track.

* * * * *